US010125449B2

(12) United States Patent
Kim et al.

(10) Patent No.: US 10,125,449 B2
(45) Date of Patent: Nov. 13, 2018

(54) DRYER

(71) Applicant: LG ELECTRONICS INC., Seoul (KR)

(72) Inventors: Jongseok Kim, Seoul (KR); Daeyun Park, Seoul (KR); Byeongjo Ryoo, Seoul (KR)

(73) Assignee: LG Electronics Inc., Seoul (KR)

( * ) Notice: Subject to any disclaimer, the term of this patent is extended or adjusted under 35 U.S.C. 154(b) by 342 days.

(21) Appl. No.: 14/962,288

(22) Filed: Dec. 8, 2015

(65) Prior Publication Data

US 2016/0160426 A1 Jun. 9, 2016

(30) Foreign Application Priority Data

Dec. 9, 2014 (KR) ..... 10-2014-0176063
Dec. 9, 2014 (KR) ..... 10-2014-0176068

(51) Int. Cl.
*D06F 58/08* (2006.01)
*D06F 58/04* (2006.01)

(52) U.S. Cl.
CPC ..... *D06F 58/08* (2013.01); *D06F 58/04* (2013.01)

(58) Field of Classification Search
CPC ..... D06F 58/04; D06F 58/08
See application file for complete search history.

(56) References Cited

U.S. PATENT DOCUMENTS

| | | | |
|---|---|---|---|
| 6,971,189 | B1 | 12/2005 | Anibas |
| 7,942,025 | B1 | 5/2011 | Musone |
| 2003/0110816 | A1 | 6/2003 | Chang |

FOREIGN PATENT DOCUMENTS

| | | | |
|---|---|---|---|
| CN | 1139162 | | 1/1997 |
| GB | 1148041 | | 4/1969 |
| GB | 2369423 | | 5/2002 |
| KR | 0144425 | | 1/1996 |
| KR | 1996-0003410 | A | 4/1996 |
| KR | 10-0144425 | A | 10/1998 |
| KR | 10-0192610 | A | 6/1999 |
| KR | 10-0202818 | A | 6/1999 |
| KR | 2000-0014060 | A | 3/2000 |
| KR | 20-0264776 | A | 2/2002 |

(Continued)

OTHER PUBLICATIONS

Chinese Office Action in Chinese Application No. 201510901082.1, dated May 22, 2017, 13 pages (with English translation).

(Continued)

*Primary Examiner* — Jessica Yuen
(74) *Attorney, Agent, or Firm* — Fish & Richardson P.C.

(57) ABSTRACT

A dryer includes a drum configured to receive a laundry item within its internal volume, a variable member positioned within the drum and configured to be movable in a length-wise direction of the drum to thereby vary the internal volume of the drum, a motor disposed on a rear surface of the drum, the motor including a rotation shaft that is configured to rotate in a forward rotation direction or a reverse rotation direction, an adjustment shaft coupled to the rotation shaft and configured to extend to a preset position inside the drum, and a bracket fitted to the adjustment shaft and configured to couple the variable member and the adjustment shaft. The coupling of the variable member and the adjustment shaft enables movement of the variable member according to a rotation of the adjustment shaft.

17 Claims, 17 Drawing Sheets

(56) References Cited

FOREIGN PATENT DOCUMENTS

| | | | |
|---|---|---|---|
| KR | 10-0644842 | | 11/2006 |
| KR | 10-0754868 | A | 9/2007 |
| KR | 10-0965649 | A | 6/2010 |
| KR | 2011-0023320 | A | 3/2011 |
| KR | 2012-0029044 | A | 3/2012 |
| WO | 2008/072889 | | 6/2008 |

OTHER PUBLICATIONS

Korean Office Action dated Jul. 9, 2015 for Korean Application No. 10-2014-0176063, 7 pages.
Korean Office Action dated Jul. 9, 2015 for Korean Application No. 10-2014-0176068, 6 pages.
Extended European Search Report issued in European Application No. 15198504.1 dated Apr. 5, 2016, 9 pages.

DRYER

CROSS-REFERENCE TO RELATED APPLICATION

Pursuant to 35 U.S.C. § 119(a), this application claims the benefit of earlier filing date and right of priority Korean Application No. 10-2014-0176063, filed on Dec. 9, 2014, and Korean Application No. 10-2014-0176068, filed on Dec. 9, 2014, the contents of which are incorporated by reference herein in their entirety.

FIELD

The present disclosure relates to a dryer and in particular a dryer that allows changing an internal volume of a drum.

BACKGROUND

In general, a clothes dryer is a device that can dry laundry by blowing heated air generated by a heater to the interior of a drum to evaporate moisture contained in the laundry.

Clothes dryers may be classified as an exhaust type clothes dryer and a condensing type clothes dryer depending on whether humid air which has passed through the drum after drying the laundry circulates.

In some cases when users dry a target dry item, the users do not introduce the target dry item into a drum up to an allowable maximum capacity of the drum. This corresponds to a case where a volume of the drum may not be effectively used.

In dryers, energy and time which are expended in drying a unit mass of wet target dry items may be about 5% to 10% more in a case where approximately half of the drum is filled with the wet target dry items compared to a case where the drum is filled to its maximum capacity with the wet target dry items. This can occur because when high-temperature dry air that is input through a drum inlet passes by a piece of clothing, a flow of non-effective air that contributes little to nothing to an actual drying operation may be formed. This effect may be referred to as a bypass effect for convenience.

SUMMARY

According to one aspect, a dryer includes a drum configured to receive a laundry item within its internal volume, a variable member positioned within the drum and configured to be movable in a lengthwise direction of the drum to thereby vary the internal volume of the drum, a motor disposed on a rear surface of the drum, the motor including a rotation shaft that is configured to rotate in a forward rotation direction or a reverse rotation direction, an adjustment shaft coupled to the rotation shaft and configured to extend to a preset position inside the drum, and a bracket fitted to the adjustment shaft and configured to couple the variable member and the adjustment shaft. The coupling of the variable member and the adjustment shaft enables movement of the variable member according to a rotation of the adjustment shaft.

Implementations according to this aspect may include one or more of the following features. For example, the adjustment shaft may include a protrusion pin that extends transversely from one or more sides of the adjustment shaft, and the bracket may be coupled to the protrusion pin and configured to move forward or backward along the lengthwise direction of the drum according to a rotation of the protrusion pin. In some cases, the bracket may further include a body member defining a hollow portion, the hollow portion being configured to receive the adjustment shaft, a coupling member disposed on one end of the body member, the coupling member extending transversely relative to a lengthwise direction of the body member, and a slot that is defined to extend in a spiral shape, the slot being configured to fittingly receive the protrusion pin, while at least a portion of the coupling member may be coupled to the variable member. The bracket may be configured to, based on the protrusion pin rotating with the adjustment shaft, rotate relative to the adjustment shaft in response to a pressure applied on the bracket by the protrusion pin through the slot. Additionally, the bracket may be configured to, based on the adjustment shaft rotating in a first direction, move the variable member toward a front surface of the drum to thereby reduce the internal volume of the drum, and the bracket may be configured to, based on the adjustment shaft rotating in a second direction that is opposite the first direction, move the variable member toward a rear surface of the drum to thereby increase the internal volume of the drum.

In some implementations, the coupling member may be coupled to the variable member by at least one of a pin or a bolt. The variable member may include a circular plate having an area that corresponds to an internal cross-sectional surface of the drum, the circular plate being configured to push out the laundry item by moving relative to the drum, and a protrusion that protrudes from a center portion of the circular plate, the protrusion defining a hollow portion configured to surround the adjustment shaft. In some cases, the body member may extend in the lengthwise direction of the drum to thereby allow the variable member to move within a predetermined range from a rear surface of the drum according to a rotation of the adjustment shaft, and the slot may extend in a spiral shape along the lengthwise direction of the body member. The predetermined range within which the variable member moves may be a distance between a first position at which the circular plate is disposed adjacent to the rear surface of the drum, and a second position at which the protrusion is disposed adjacent to a door of the drum.

In some cases, according to this aspect, the circular plate may include a concave-convex portion that is configured to enlarge a contact area between the circular plate and the laundry item, at least a portion of the circular plate being protruded or recessed. The motor may be configured to either stop rotation or rotate in a reverse direction according to a force that is applied by the laundry item on the variable member. The motor may be configured to, based on the force applied to the variable member being equal to a predetermined force, stop rotation, and the motor may be configured to, based on the force applied to the variable member being greater than the predetermined force, rotate in the reverse direction until the force applied to the variable member becomes equal to the predetermined force. Additionally, the protrusion may further include a coupling part that extends to a rear surface of the drum along an outer circumference of the protrusion, the coupling part being configured to be coupled to the coupling member. At least a portion of a rear surface of the drum may be recessed to accommodate a portion of the body member.

DETAILED DESCRIPTION

Description will now be given in detail of various examples, with reference to the accompanying drawings.

Figure 1:
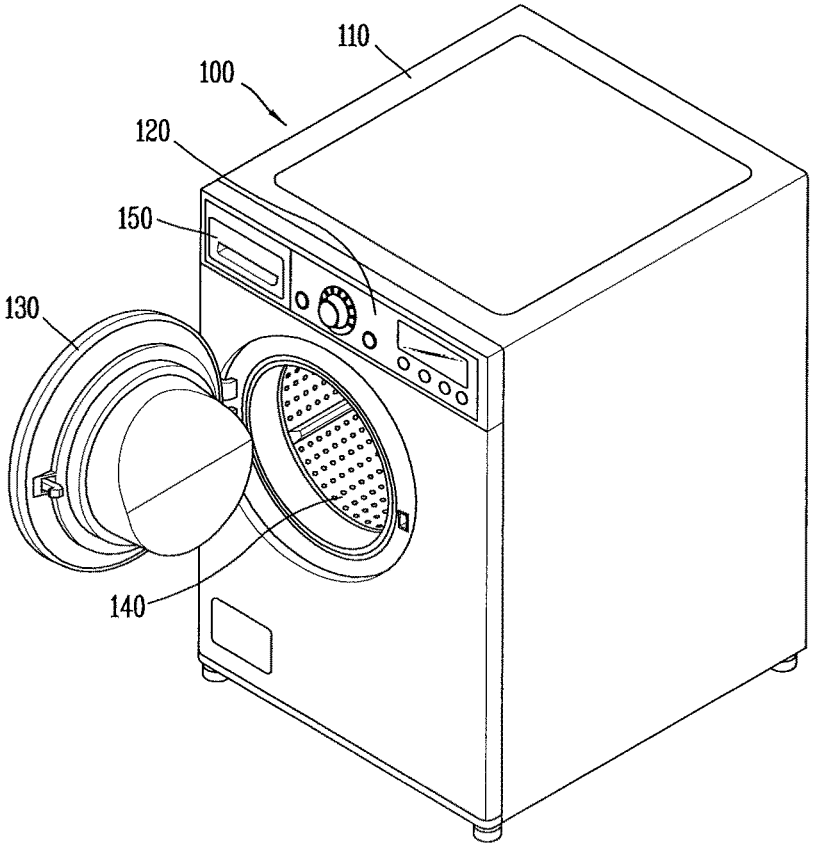
FIG. 1 is a schematic diagram illustrating an external appearance of an example dryer.

FIG. 1 is a schematic diagram illustrating an external appearance of a dryer 100.

Referring to FIG. 1, the dryer 100 may include a cabinet 110, which forms an external appearance of the dryer 100, and a main drum 140 that is rotatably disposed in the cabinet 110 and includes a plurality of lifters which are disposed to protrude on an inner circumference surface thereof. An introduction port 140 for introducing clothes, which are target dry items, into the cabinet 110 may be disposed in a front surface of the cabinet 110.

The introduction port 140 may be opened or closed by a door 130, and a control panel 120 in which a display device and various manipulation buttons for manipulating the dryer 100 are disposed may be disposed on the introduction port 140. A drawer 150 may be disposed on one side of the control panel 120, and liquid that can be sprayed to the drum 140 may be stored in the drawer 150.

A target dry item takeout mode may refer to a mode in which a drying operation has ended at least some of target dry items are subsequently taken out from the drum 140 by moving a variable member according to a rotation of the drum 140. The target dry item takeout mode will be described below in further detail.

$$\eta_{drying.dbt.} = \frac{w_{in} - w_{out}}{w_{sAH.in} - w_{out}} \times 100 \quad (1)$$

Referring to Eq. (1), drying efficiency η may be expressed as a ratio of a difference between absolute humidity and evaporator outlet absolute humidity at a dry-bulb temperature in an outlet of the drum 140 (i.e., an inlet of the evaporator) to a difference between evaporator inlet dry-bulb temperature reference saturation absolute humidity and evaporator outlet absolute humidity. An internal evaporation efficiency of the drum 140 may be compared by using the drying efficiency. As the evaporation efficiency increases, a bypass effect may be reduced. One physical meaning of this may be that input heat energy transferred well to moisture remaining in a cloth, and thus, drying is effectively performed.

Figure 2:
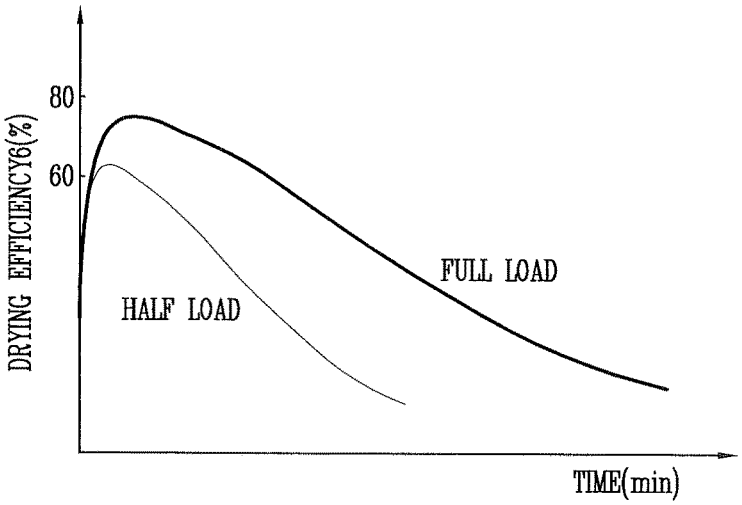
FIG. 2 is a graph illustrating example drying efficiency with respect to time for a full load and a half load of target items to be dried.

FIG. 2 is an example graph showing drying efficiency with respect to a time for a full load and a half load of target items to be dried.

Referring to FIG. 2, drying efficiency with respect to time is shown for a first case where target dry items are fully filled into the drum 140 (e.g. full load) and a second case where approximately half of an internal volume of the drum 140 is filled with target dry items (e.g. half load). In this example graph, most of dry air is used to evaporate water contained within target dry items in the full load, and evaporation efficiency is generally higher in the full load than the in the half load until drying is completed.

Figure 3A:
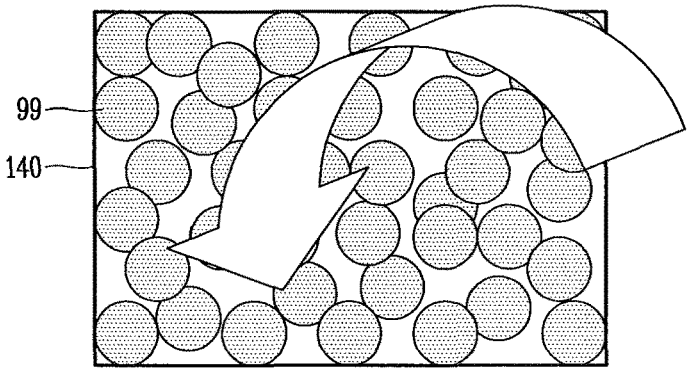
FIGS. 3A to 3C are conceptual diagrams showing a flow of air based on an example internal volume change of a drum and the number of target dry items in a drum.
Figure 3B:
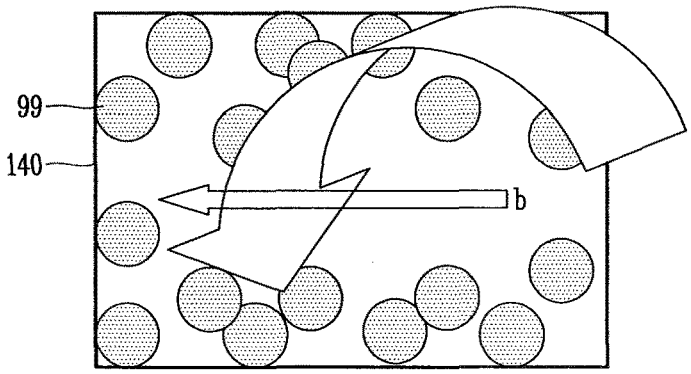
Figure 3C:
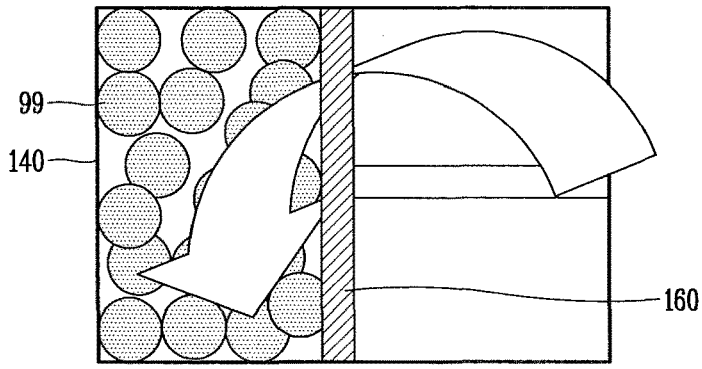

FIGS. 3A to 3C are conceptual diagrams showing an example flow of air based on an internal volume change of the \drum 140 and the number of target dry items 99 in the drum 140.

FIG. 3A is a conceptual diagram illustrating an example case in which the target dry items 99 are fully filled into the drum 140, FIG. 3B is a conceptual diagram illustrating an example case in which relative fewer target dry items 99 are filled into the drum 140, and FIG. 3C is a conceptual diagram illustrating an example state where an internal volume of the drum 140 is reduced compared the case of FIG. 3B.

Referring to FIG. 3A, when the target dry items 99 are relatively fully filled into the drum 140, all or most of air which is intaken into the drum 140 for drying the target dry items 99 may come in contact with the target dry items 99 before being transferred externally. That is, for the air that is intaken into the drum 140, the amount of air which is transferred to outside the drum 140 without participating in a drying operation may be relatively small.

On the other hand, referring to FIG. 3B, the target dry items 99 may be filled into the drum 140 to occupy approximately half of an internal volume of the drum 140. In this case, some of heated air intaken into the drum 140 for drying may be discharged to outside the drum 140 without participating in a drying operation. Such air may be referred to as bypass air "b." As the amount of bypass air increases, a drying efficiency of the dryer may be lowered.

Referring to FIG. 3C, when the target dry items 99 are not fully filled into the drum 140 as illustrated in FIG. 3B, the internal volume of the drum 140 may be reduced by moving a variable member 160 into the drum 140. In this case, the amount of bypass air "b" may be reduced compared to the case illustrated in FIG. 3B.

Figure 4:
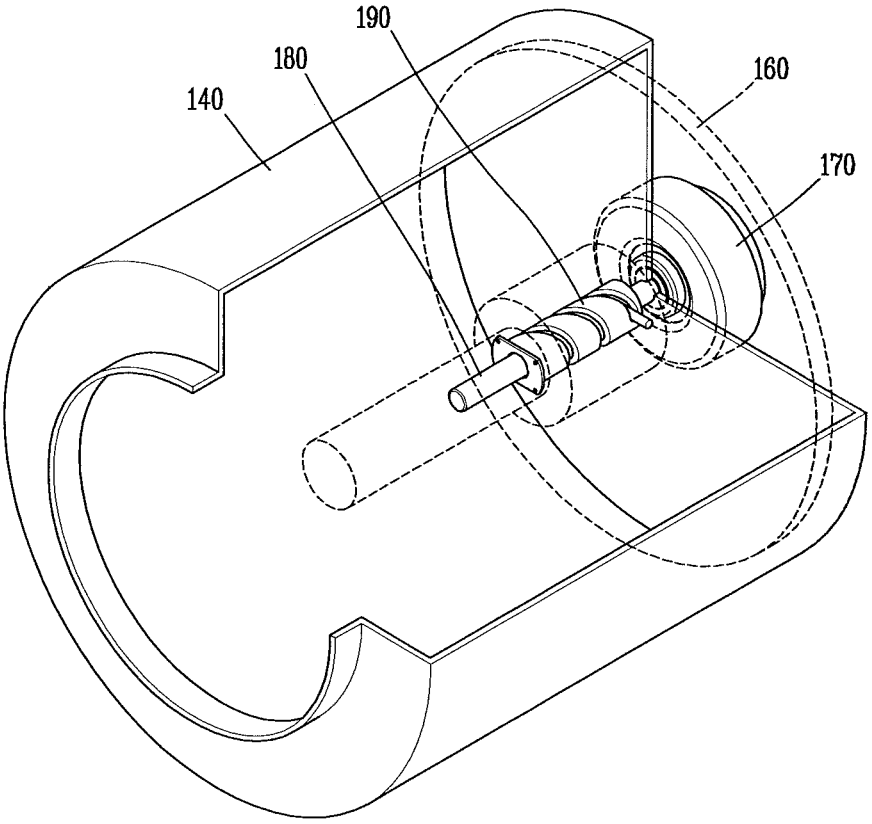
FIG. 4 is a conceptual diagram illustrating an example drum and an example connection relationship between a variable member, a shaft, and a motor which are disposed in the drum.

FIG. 4 is a conceptual diagram illustrating an example connection relationship between the drum 140 and a variable member 160, a shaft 180, and a motor 170 which are disposed in the drum 140.

Referring to FIG. 4, the dryer 140 according to one implementation may include the variable member 160, the shaft 180, the motor 170, and a bracket 190.

The variable member 160 may be disposed to be movable in a lengthwise direction of the drum 140 thereby allowing an internal volume of the drum 140 accommodating a target dry item to vary.

The motor 170 may be disposed on a rear surface of the drum 140 and may include a rotation shaft that rotates in a forward direction or a reverse direction.

The shaft 180, also referred to as the adjustment shaft 180, may be coupled to the rotation shaft. In some cases, the shaft 180 may be further extended to a preset position inside the drum 140.

The bracket 190 may be positioned by being fitted to the shaft 180. The bracket 190 may be coupled to the variable member 160 and the shaft 180 to allow the variable member 160 and the shaft 180 to rotate as one body. Also, the bracket 190 may be provided to move the variable member 160 according to a rotation of the shaft 180.

Figure 5:
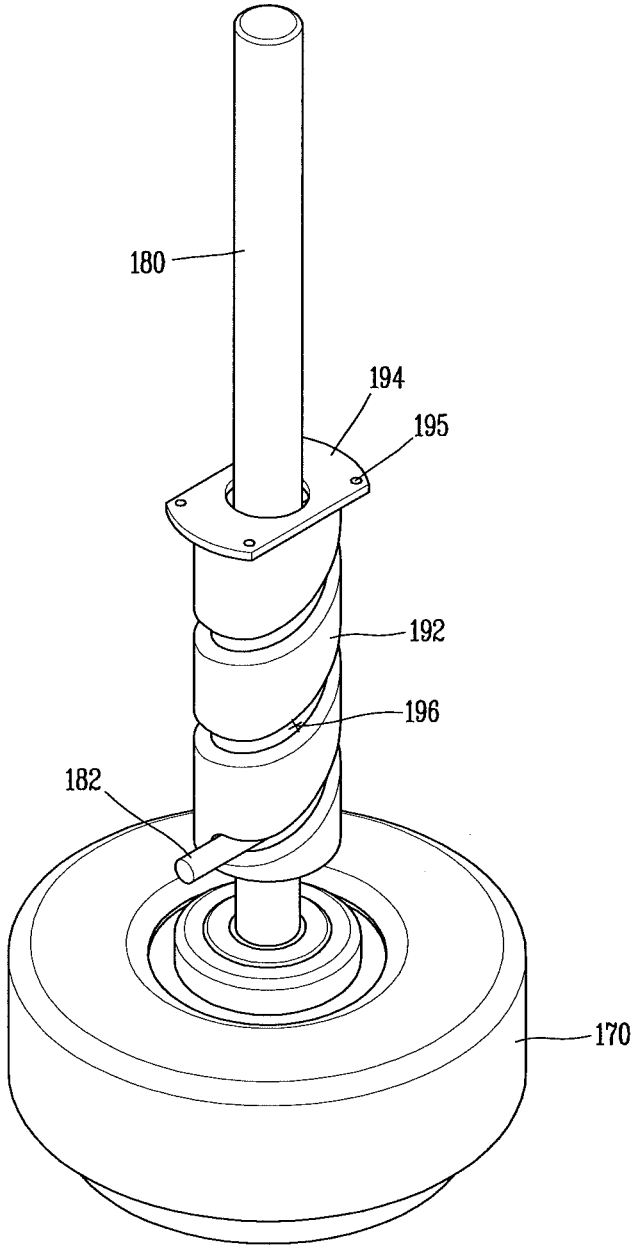
FIG. 5 is a perspective view illustrating an example state where a motor, a shaft, and a bracket are coupled to each other.

FIG. 5 is a perspective view illustrating an example state where the motor 170, the shaft 180, and the bracket 190 are coupled to each other.

Referring to FIG. 5, the shaft 180 may further include a protrusion pin 182 that is transverse to a lengthwise direction of the shaft 180 protrudes from the side of shaft 180. The protrusion pin 182 may protrude from one side or multiple, such as opposing, sides of the shaft 180.

The bracket 190 may be fitted to the protrusion pin 182 and may be provided to move forward or backward according to a rotation of the protrusion pin 182.

In some cases, the bracket 190 may include a body member 192, a coupling member 194, and a slot 196.

The body member 192 may include a hollow portion into which the shaft 180 is fitted. The shaft 180 may rotate in the hollow portion of the body member 192.

The coupling member 194 may be disposed on one end of the body member 192. Also, the coupling member 194 may extend transverse to a lengthwise direction of the body member 192. As described above, the coupling member 194 may couple the bracket 190 to the variable member 160. At least a portion of the coupling member 194 may be coupled to the variable member 160. In some cases, the coupling member 194 may have an approximately tetragonal plate shape. Also, a hole 195 for coupling the coupling member 194 to the variable member 160 with a pin or a bolt may be formed in each of edges of the tetragonal plate.

The slot 196 may be provided to extend in a spiral shape along the lengthwise direction of the body member 192. Also, the protrusion pin 182 may be fitted into the slot 196. When the protrusion pin 182 rotates in one direction, pressure may be applied on the slot 196 by the protrusion pin 182 to cause the body member 192 to rotate relative to the shaft 180.

The body member 192 may be provided to extend in the lengthwise direction in order for the variable member 160 to move within a predetermined range on a rear surface of the drum 140 according to a rotation of the shaft 180.

Moreover, the slot 196 may be provided to extend in a spiral shape along the lengthwise direction of the body member 192.

Figure 6A:
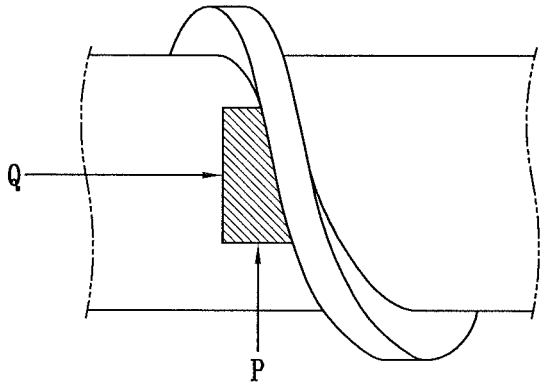
FIGS. 6A and 6B are conceptual diagrams illustrating an example state based on a force with which a protrusion pin protruding through a slot of a bracket applies pressure to a body member of the bracket.
Figure 6B:
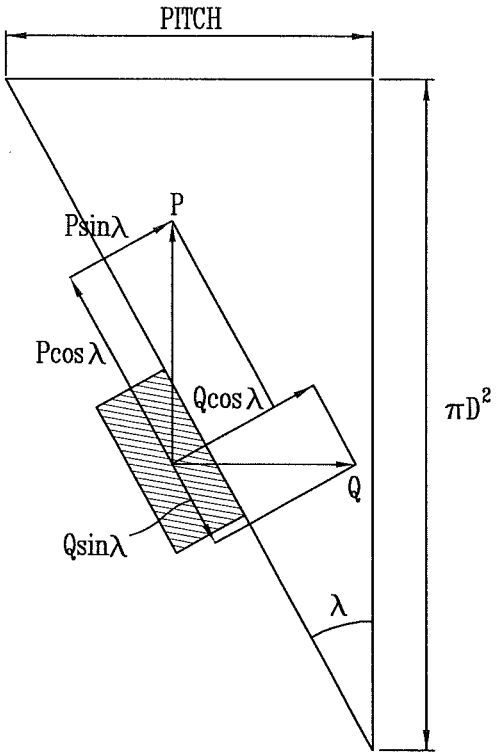

FIGS. 6A and 6B are conceptual diagrams illustrating an example force with which a protrusion pin protruding through a slot of a bracket applies pressure to a body member of the bracket.

Referring to FIGS. 6A and 6B, a force necessary for rotating the variable member 160 may be referred to as P, and a resistance of the shaft 180 in an axial direction may be referred to as Q. In this case, when an angle (i.e. a lead angle) between the slot 196 and the protrusion pin 182 is $\lambda$, "$\tan \lambda = \text{Pitch}/\pi D2$" may be established.

In this case, a normal force may be "$Q \cos \lambda + P \sin \lambda$," and a lateral force may be "$P \cos \lambda - Q \sin \lambda$." Also, when a frictional force acts in a parallel direction and the lateral force maintains balance due to the normal force, "$P \cos \lambda - P \sin \lambda = \mu(Q \cos \lambda + P \sin \lambda)$ may be established. Also, $P(\cos \lambda - \mu P \sin \lambda) = Q(\mu \cos \lambda + \sin \lambda)$ may be established.

Here, a friction coefficient of the bracket 190 and the protrusion pin 192 may be referred to as $\mu$, and a frictional angle may be referred to as $\rho$. When $\mu = \tan \rho$, "$P = Q (\tan \rho + \tan \lambda)/(1 - \tan \rho \tan \lambda) = Q \tan (\lambda + \rho)$" may be established. As a result, a force acting in the axial direction may be expressed as $Q = P/\tan (\lambda + \rho)$.

Figure 7A:
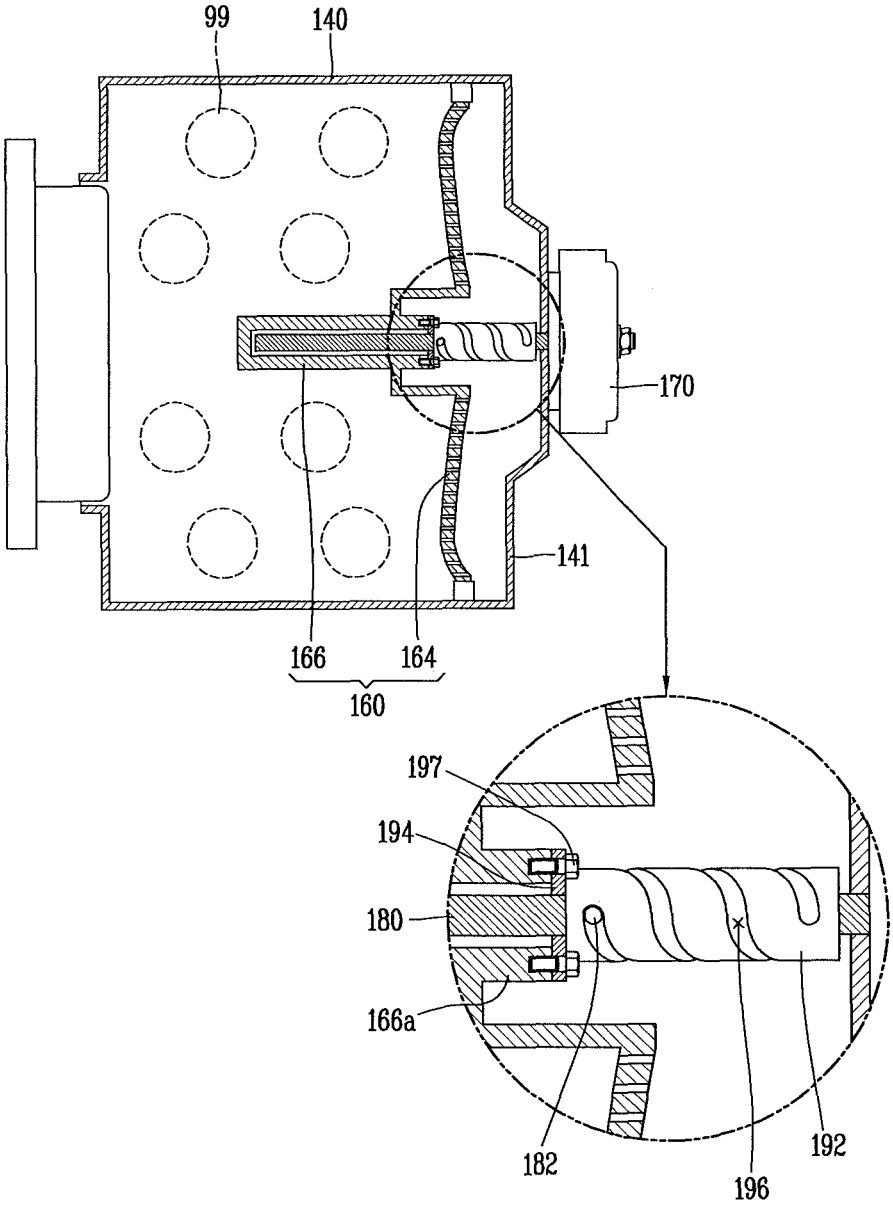
FIGS. 7A and 7B are conceptual diagrams respectively illustrating an example structure corresponding to a first position at which a variable member is disposed adjacent to a rear surface of a drum and an example structure corresponding to a second position at which the variable member is disposed adjacent to a front surface of the drum.
Figure 7B:
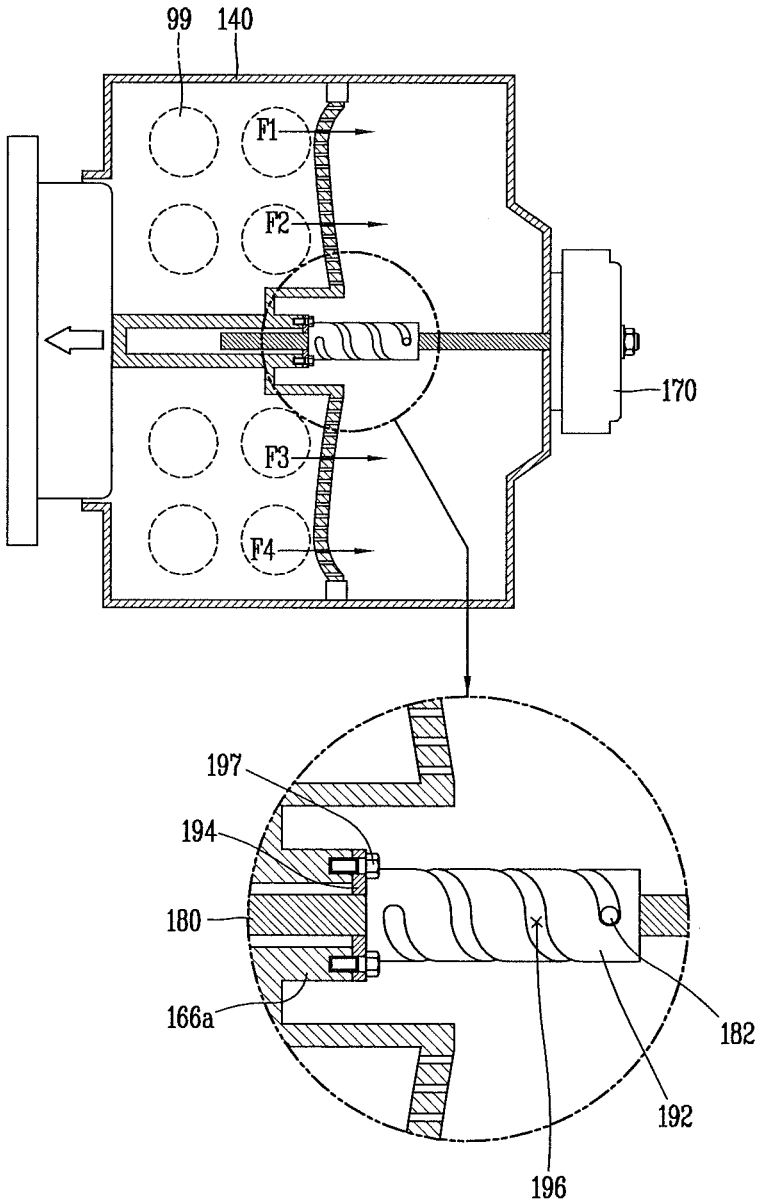

FIGS. 7A and 7B are conceptual diagrams respectively illustrating example structures corresponding to a first position at which the variable member 160 is disposed adjacent to a rear surface 141 of the drum 140 and a second position at which the variable member 160 is disposed adjacent to a front surface of the drum 140.

First, referring to FIG. 7A, the variable member 160 may be disposed adjacent to the rear surface 141 of the drum 140. Such a state may be referred to as a first position. Although the variable member 160 is not shown contacting the rear surface 141 of the drum 140 in the drawing, the variable member 160 may be brought in contact with the rear surface 141 of the drum 140 by adjusting a length of the body member 192 or adjusting a recessed portion of the drum 140.

The shaft 180 may rotate according to a rotation of the motor 170. Also, the protrusion pin 182 protruding from the shaft 180 may rotate along with the shaft 180.

When the shaft 180 rotates in one direction, the bracket 190 may move the variable member 160 to a front surface of the drum 140 so as to reduce an internal volume of the drum 140.

Moreover, when the shaft 180 rotates in another direction, the bracket 190 may move the variable member 160 to the rear surface 141 of the drum 140 so as to increase the internal volume of the drum 140.

The variable member 160 may include a circular plate 164, which is provided to have an area corresponding to an internal cross-sectional surface of the drum 140, and a protrusion 166. The circular plate 164 may be provided to push out a target dry item when moving. The protrusion 166 may protrude from a center portion of the circular plate 164 to surround the shaft 180 and include a hollow portion.

The predetermined range in which the variable member 160 moves may be a distance between a first position, at which the circular plate 164 is disposed adjacent to the rear surface of the drum 140, and a second position at which the protrusion 166 is disposed adjacent to the door 130. In other words, the variable member 160 may move (see FIG. 5B) between the first position, at which the circular plate 164 is disposed adjacent to the rear surface of the drum 140, and the second position at which the protrusion 166 is disposed adjacent to the door 130.

The circular plate 164 may include a concave-convex portion which is provided to enlarge a contact area between the circular plate 164 and a target dry item, and at least a portion of the circular plate 164 may protrude or may be recessed.

Referring to FIG. 7B, the variable member 160 may move to a front surface to reduce the internal volume of the drum 140 accommodating a target dry item, thereby applying pressure on the target dry items 99.

Moreover, the target dry items 99 may in turn apply a pressure on the variable member 160. As described above, the motor 170 may be based on a force "$Q=P/\tan(\lambda+\rho)$" that acts on the bracket 190 in the axial direction.

The motor 170 may stop rotation or may rotate in a reverse direction, based on a force at which the target dry items 99 applies pressure on the variable member 160. For example, when the force applied to the variable member 160 is equal to a predetermined force, the motor 170 may stop rotation. Also, when the force applied to the variable member 160 is greater than the predetermined force, the motor 170 may rotate in the reverse direction until the force applied to the variable member 160 becomes equal to the predetermined force.

In this case, it may be assumed that a total sum of forces at which the target dry items 99 apply pressure on the variable member 160 is expressed as "$F5=F1+F2+F3+F4$." When F5 is greater than Q, the variable member 160 may move in a direction toward the rear surface of the drum 140, and when F5 becomes equal to Q, the variable member 160 may stop. Also, when F5 is less than Q, the variable member 160 may move forward.

The protrusion 166 may further include a coupling part 166*a* that extends to the rear surface of the drum 140 along an outer circumference of the protrusion 166 to be coupled to the coupling member 194.

In some cases, at least a portion of the rear surface of the drum 140 may be recessed to accommodate a portion of the body member 192.

Figure 8:
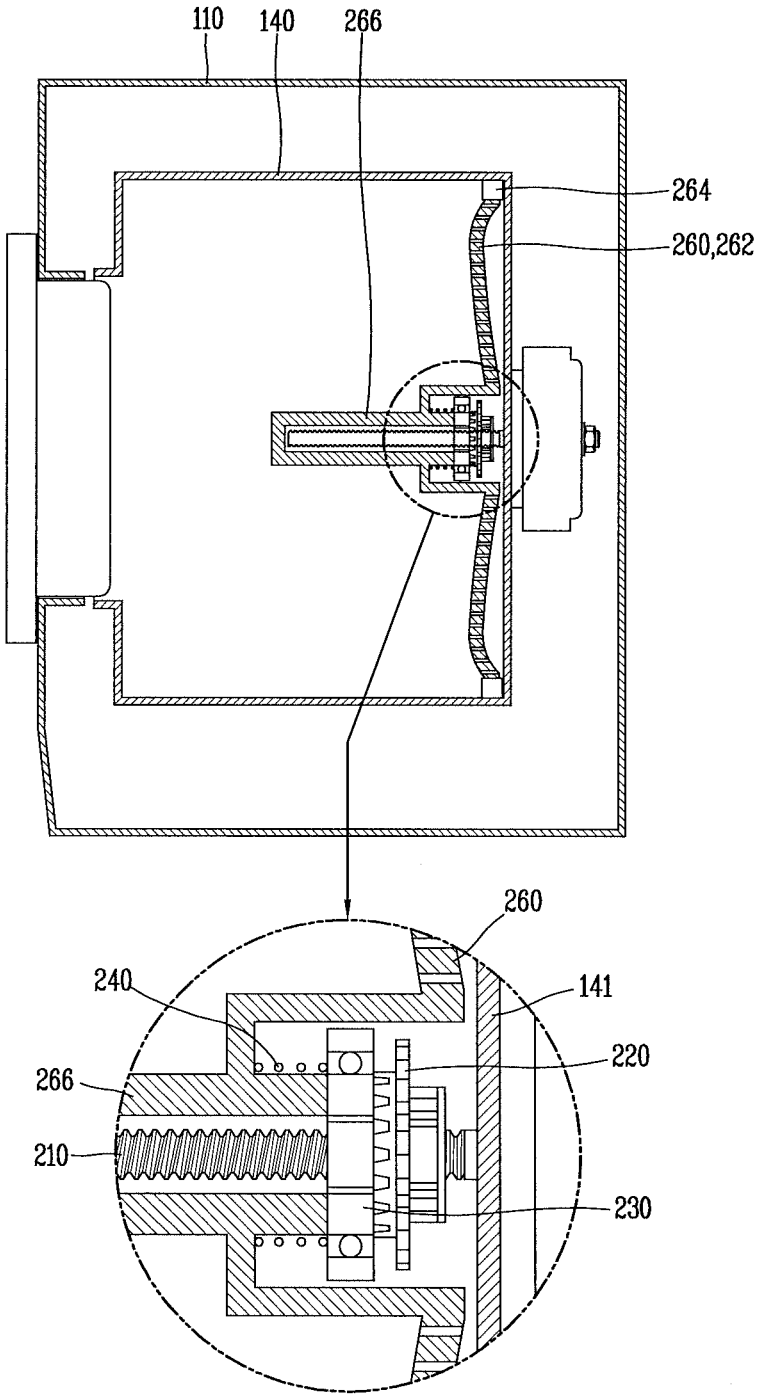
FIG. 8 is a schematic diagram illustrating an example internal structure of a dryer in which a variable member and a moving unit are disposed.

FIG. 8 is a schematic diagram illustrating an example internal structure of a dryer in which a variable member 260 and a moving unit 200 are disposed.

Referring to FIG. 8, an example dryer may include a cabinet 110, a drum 140, the variable member 260, and the moving unit 200. The cabinet 110 forms an external appearance of the dryer.

The drum 140 may be rotatably disposed in the cabinet 110. Also, the drum 140 may include a space that accommodates the target dry items 99.

The variable member 260 may be disposed in the drum 140. Also, the variable member 260 may be disposed to be rectilinearly moved in the drum 140 along a lengthwise direction of the drum 140 in order for an internal volume of the drum 140 to vary.

The moving unit 200 may be disposed between the rear surface of the drum 140 and the variable member 260. Also, the moving unit 200 may be provided to move the variable member 260 according to the drum 140 being rotated.

In some cases, the moving unit 200 may include a shaft 210, a first clutch 220, a second clutch 230, and a spring 240.

The shaft 210 may protrude in a direction away from the rear surface of the drum 140 and toward a door of the drum 140. Also, the shaft 210 may include a screw thread in order for the second clutch 230 to move forward while rotating.

The first clutch 220 may be coupled to the variable member 260 as one body. Also, a saw tooth may be formed in one end of the first clutch 220 to be coupled to the second clutch 230.

The second clutch 230 may be disposed to engage with the saw tooth of the first clutch 220. Also, the second clutch 230 may be rotated by the screw thread and may be coupled to the screen thread so as to move forward and backward on the shaft 210.

The spring 240 may be disposed between the variable member 260 and the second clutch 230. One side of the spring 240 may be supported by the variable member 260, and the other side may apply pressure on the second clutch 230 in order for the second clutch 230 to engage with the first clutch 220.

Hereinafter, an example operation of the moving unit 200 will be described in detail.

The screw thread may be formed to protrude from the rear surface of the drum 140. However, the screw thread may rotate together according to the drum 140 being rotated. This is because the first clutch 220 and the second clutch 230 rotate according to a rotation of the drum 140 to move in a lengthwise direction of the screw thread.

The first clutch 220 may be provided as one body with the variable member 260. Also, the second clutch 230 may be provided in order for a saw tooth thereof to engage with the first clutch 220. Also, the second clutch 230 may be coupled to the screw thread. Therefore, when the second clutch 230 rotates with respect to the shaft 210 or the screw thread rotates with respect to the second clutch 230, the second clutch 230 may move forward or backward in a lengthwise direction of the shaft 210.

The spring 240 may apply pressure on the second clutch 230 to engage with the first clutch 220.

When the drum 140 rotates, the screw thread may rotate along with the drum 140. Also, the second clutch 230 engaging with the screw thread may be relatively rotated. The first clutch 220 engaging the second clutch 230 may move forward or backward according to the relative rotation of the second clutch 230. Therefore, the variable member 260 which is provided as one body with the first clutch 220 may move forward or backward.

The variable member 260 may include a concave-convex portion 262*a* for enlarging a contact area between the drum 140 and the target dry items 99 introduced into the drum 140, and at least a portion of the concave-convex portion 262*a* may be formed to protrude or to be recessed. The concave-convex portion 262*a* may effectively push out the target dry items 99, thereby decreasing an internal volume of the drum 140.

Moreover, the variable member 260 may include a protrusion 266 that surrounds the shaft 210, and at least a portion of the protrusion 266 may protrude. The protrusion 266 may prevent the shaft 210 from contacting the target dry items 99. Also, the protrusion 266 may prevent the target dry items 99 from being twisted when drying the target dry items 99.

In some cases, a hollow portion may be formed in the protrusion 266 in order for at least a portion of the shaft 210 to be inserted thereinto.

Figure 10A:
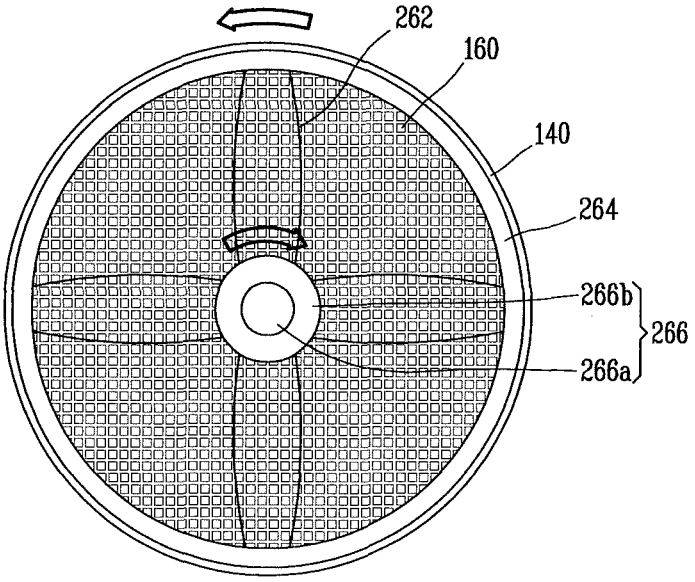
FIGS. 10A and 10B are conceptual diagrams respectively illustrating an example of cross-sectional surfaces in different directions corresponding to a rotation direction of the variable member and a moving direction of the variable member in the drum when the drum rotates in a direction different from the rotation direction illustrated in FIGS. 9A and 9B.
Figure 10B:
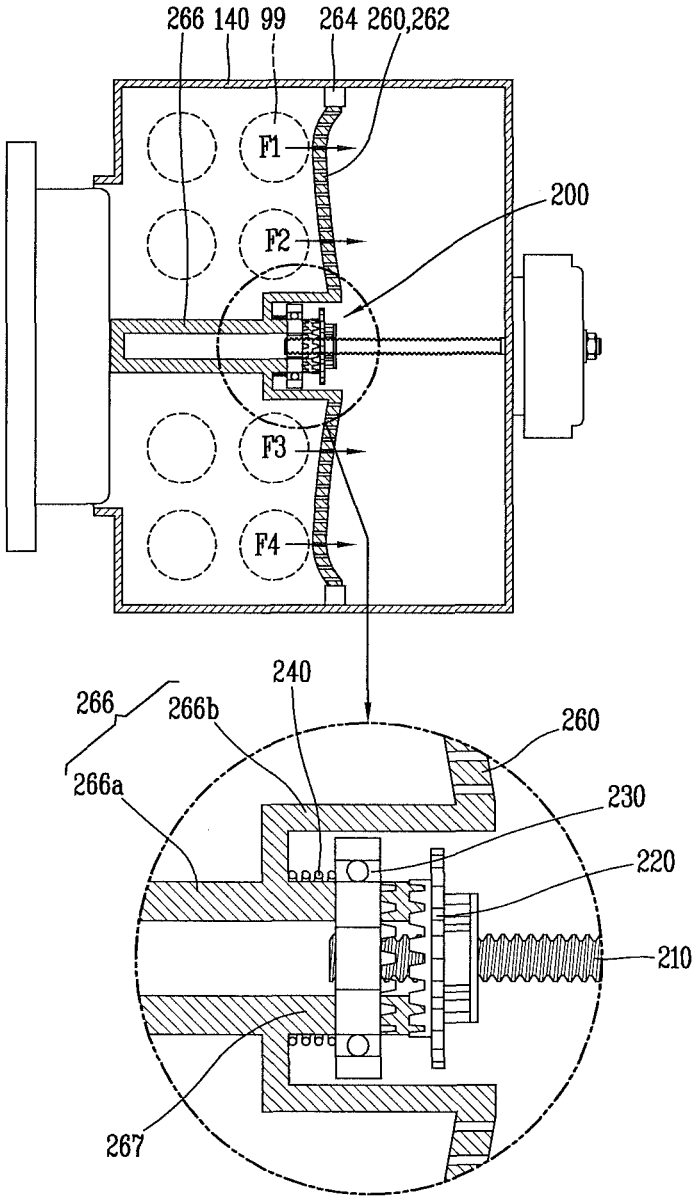

The protrusion 266 may include a first protrusion 266*a*, which accommodates the shaft 210, and a second protrusion 266 that is formed to be stepped at two stages, wherein a diameter of the second protrusion 266*b* largely extends from the first protrusion 266*a* (see FIG. 10B).

The second protrusion 266*b* may include a hollow portion which communicates with the first protrusion 266*a* in order for the shaft 210 to pass through the second protrusion 266*b*. The second protrusion 266*b* may have a diameter larger than that of the first protrusion 266*a*, for accommodating the moving unit 200. A coupling part 267 having a diameter which is the same as that of the first protrusion 266*a* may be formed to protrude to inside the second protrusion 266*b*, and the moving unit 200 (i.e., the spring 240 and the second clutch 230) may be mounted on the coupling part 267.

Figure 9A:
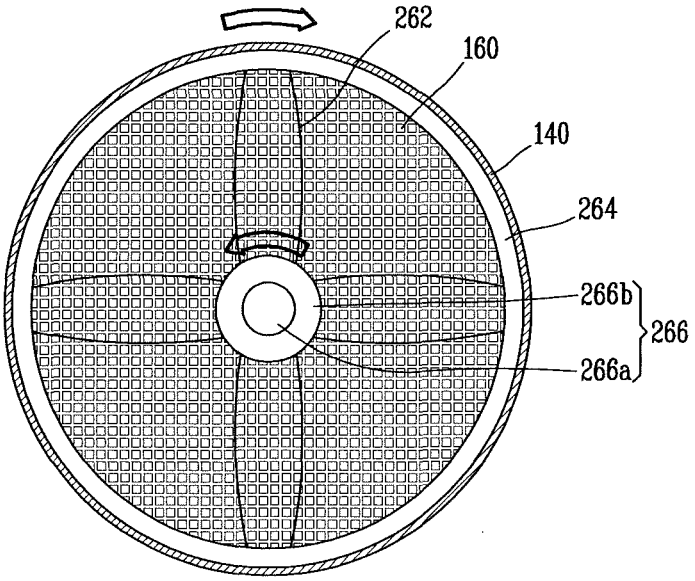
FIGS. 9A and 9B are conceptual diagrams respectively illustrating an example of cross-sectional surfaces in different directions corresponding to a rotation direction of a variable member and a moving direction of the variable member in a drum when the drum rotates.
Figure 9B:
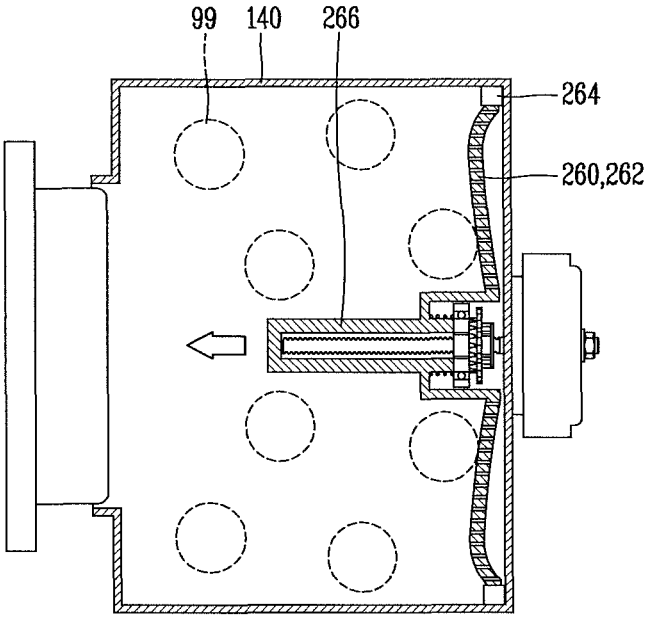

FIGS. 9A and 9B are conceptual diagrams respectively illustrating example cross-sectional surfaces in different directions corresponding to a rotation direction of the variable member 260 and a moving direction of the variable member 260 in the drum 140 when the drum 140 rotates.

Referring to FIGS. 9A and 9B, a rotation direction of the drum 140 may be the same as a clockwise direction with respect to the drawing. Also, it can be seen that the second clutch 230 may move forward according to a rotation of the screw thread, and thus, the variable member 260 may be rotated relatively in a counterclockwise direction.

In other words, when the drum 140 starts to dry the target dry items 99 and rotates in one direction (e.g. a forward direction), the screw thread may move the second clutch 230 from the rear surface to a front surface of the 140.

Moreover, the variable member 260 may be provided in a mesh form including a plurality of holes in order for air flowing into the drum 140 to be transferred to the target dry items 99. The air may pass through the variable member 260 and may be supplied from the rear surface of the drum 140 to the target dry items 99 through the plurality of holes.

FIGS. 10A and 10B are conceptual diagrams respectively illustrating example cross-sectional surfaces in different directions corresponding to a rotation direction of the variable member 260 and a moving direction of the variable member 260 in the drum 140 when the drum 140 rotates in a direction different from the rotation direction illustrated in FIGS. 9A and 9B.

Referring to FIGS. 10A and 10B, an example case where the drum 140 rotates in a reverse direction is illustrated. Accordingly, when a drying operation is completed, the drum 140 may rotate in the reverse direction.

Moreover, when the variable member 260 moves forward in a direction toward the front surface of the drum 140 and applies pressure on the target dry items 99, the first clutch 220 may be separated from the second clutch 230, and thus, despite the drum 140 being rotated, the variable member 260 may no longer move forward.

Referring to FIG. 10B, when a total sum of forces F1, F2, F3 and F4 at which the target dry items 99 apply pressure on the variable member 260 is greater than a force at which the spring 240 applies pressure on the second clutch 230 toward the first clutch 220, the first clutch 220 may be separated from the second clutch 230.

Therefore, even when the screw thread rotates or the second clutch 230 rotates, the first clutch 220 may not rotate. Accordingly, the variable member 260 may stop.

That is, as the variable member 260 receives the pressure coming from the target dry items 99, the first clutch 220 may move to inside the drum 140 along with the variable member 260 and may be separated from the second clutch 230.

The variable member 260 may be provided in a shape corresponding to an internal cross-sectional surface of the drum 140. Also, the variable member 260 may further include a sealer member 264 which is disposed on an outer circumference contacting the drum 140, in order for the target dry items 99 not to be caught in the drum 140 due to moving of the variable member 260.

The sealer member 264 may be formed of a felt material so as to reduce a friction coefficient of the drum 140 and the target dry items 99. Other materials that help reduce the friction coefficient may also be used. Also, the sealer member 264 may be mixed with at least one of rubber and sponge, among others.

FIGS. 11A to 11D is a conceptual diagram illustrating an example state where the target dry items 99 are taken out from the drum 140 by moving the variable member 260. The target dry item takeout mode may be selected by using the control panel 120 (see FIG. 1).

Figure 11A:
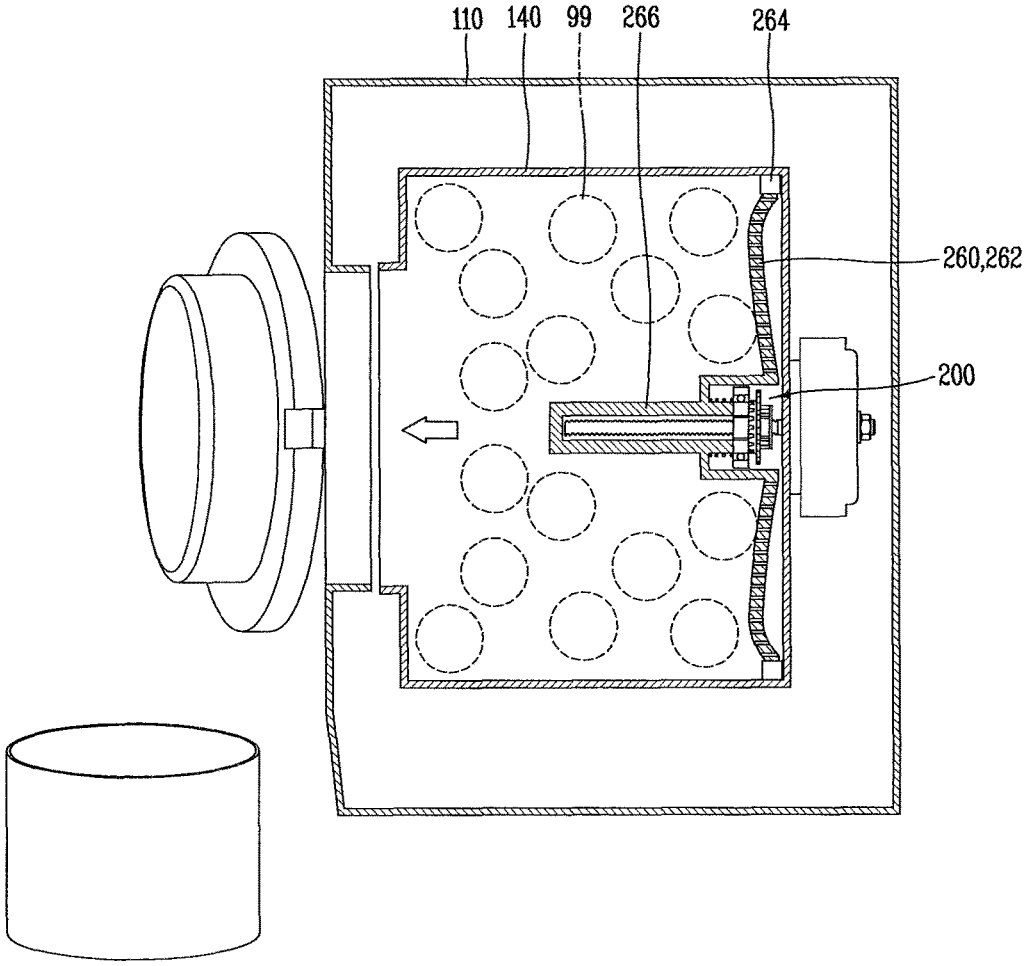
FIGS. 11A to 11D is a conceptual diagram illustrating an example state where a target dry item is taken out from a drum by moving the variable member.

Referring to FIG. 11A, the dryer may terminate drying of the target dry items 99, and a user may place a basket, which can accommodate the target dry items, in front of the dryer door 130. Also, the user may open the dryer door 130 (see FIG. 1) and then may select the target dry item takeout mode. When the door 130 is opened, even though the target dry item takeout mode may be selected by the user, the dryer may not operate.

Figure 11B:
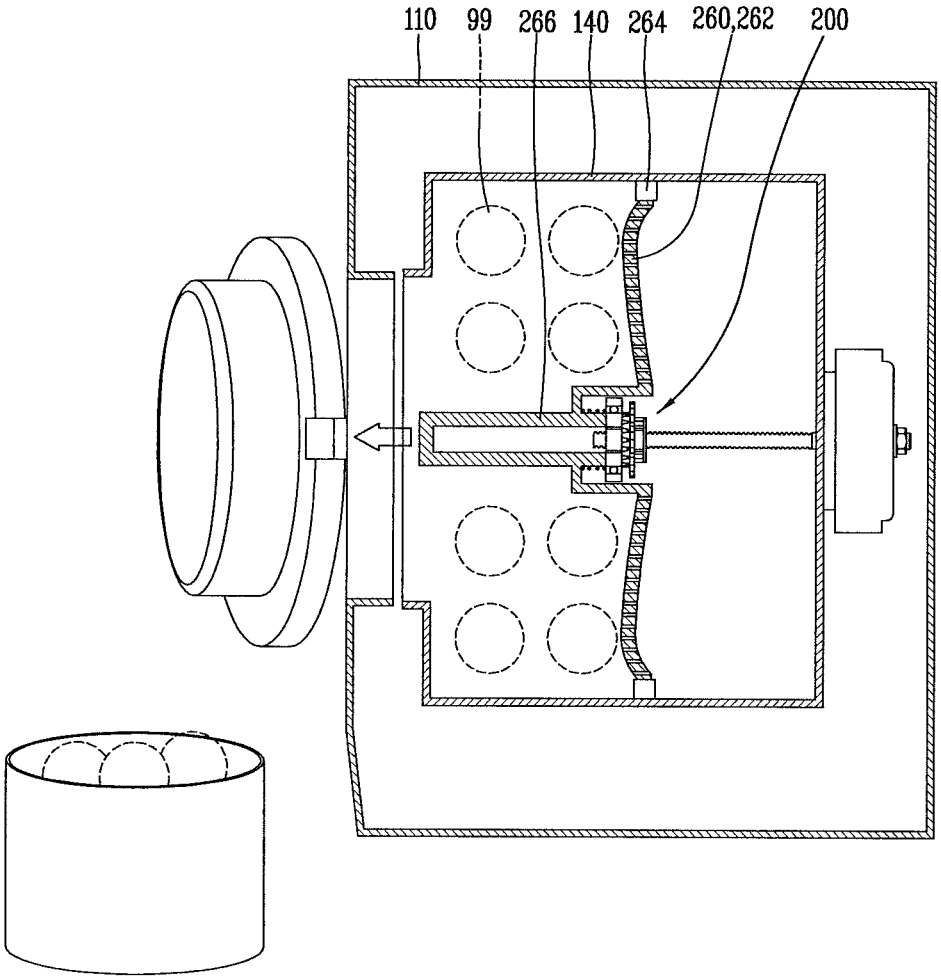

Referring to FIG. 11B, some of the target dry items 99 is shown being discharged from the drum 140.

Here, the drum 140 may rotate in a forward direction according to the target dry item takeout mode, and through the above-described operation, the variable member 260 may move in a direction toward the front surface of the drum 140. Accordingly, the target dry items 99 in the drum 140 may be discharged from the drum 140.

Figure 11C:
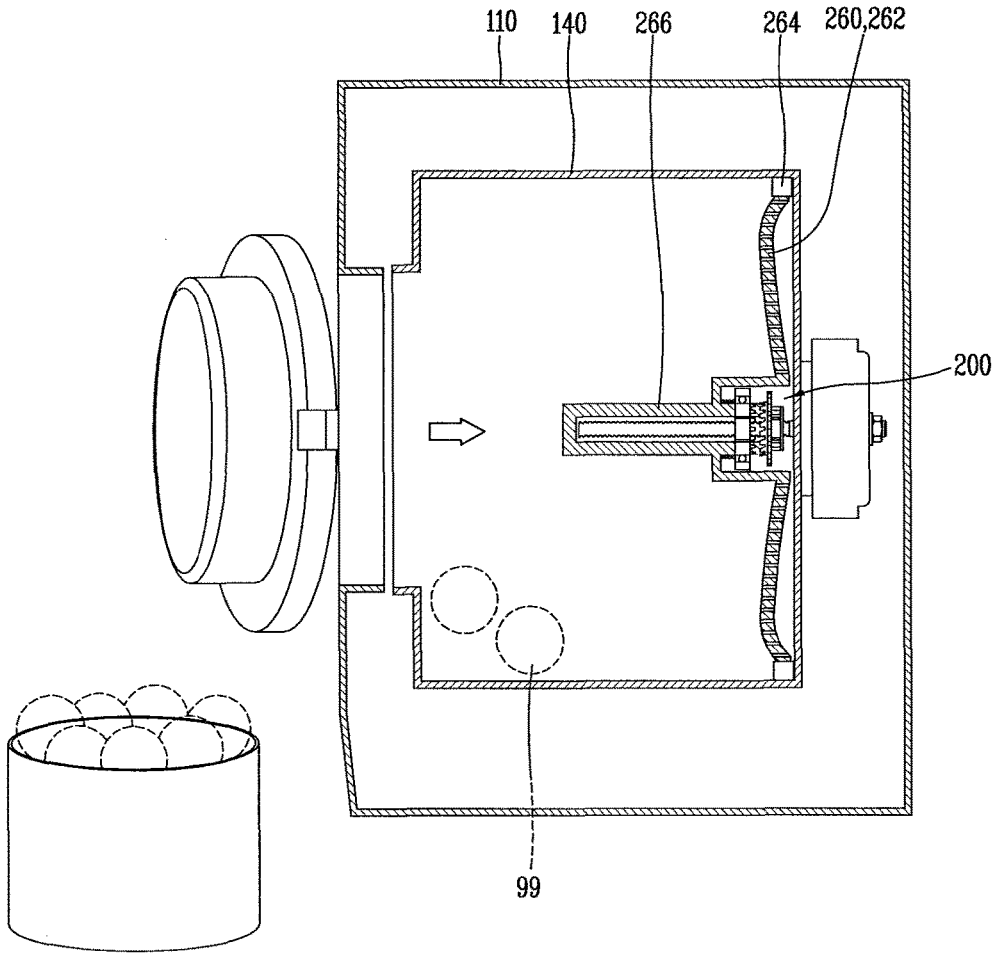

Referring to FIG. 11C, when the variable member 260 receives a certain degree of pressure or the variable member 260 protrudes up to a range which allows protrusion of the variable member 260 to the front surface of the drum 140, the drum 140 may rotate in the reverse direction. Therefore, the variable member 260 may be intaken to the rear surface of the drum 140. In some cases, some target dry items 99 which are not discharged from the drum 140 according to moving of the variable member 260 may remain in the drum 140. However, the target dry item takeout mode may terminate.

Figure 11D:
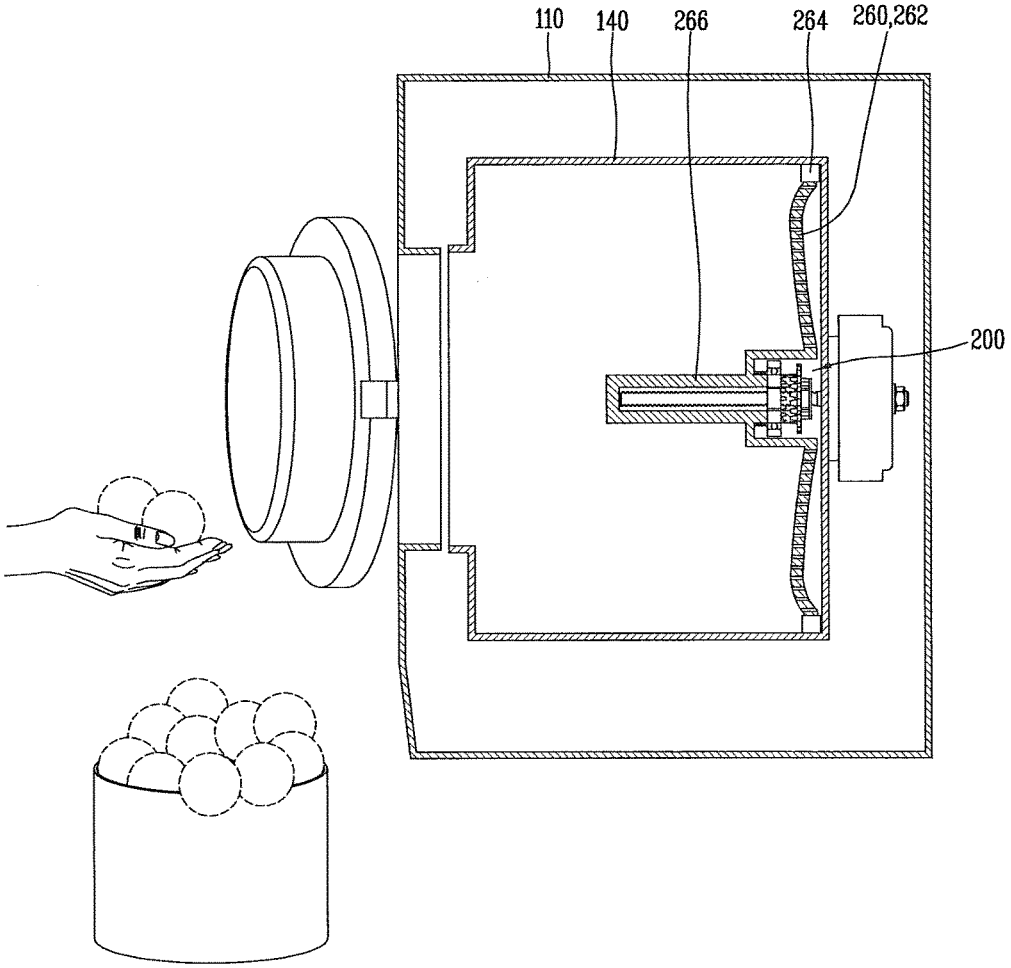

Referring to FIG. 11D, the user may pick up the some target dry items 99 remaining in the drum 140. In the target dry item takeout mode, a depth of the drum 140 may be deep, and thus, when it is difficult to take out some target dry items 99 which are located deep inside of the drum 140, the user may take out the some target dry items 99 by using the variable member 260. Also, some target dry items 99 which are not taken out may be moved to the front surface of the drum 140 using the variable member 260. Remaining items may then be removed by hand, as shown in FIG. 11D.

Figure 12A:
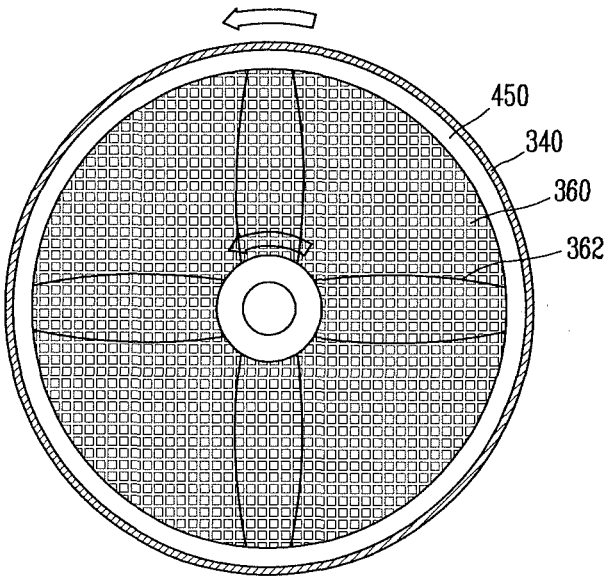
FIGS. 12A and 12B are conceptual diagrams respectively illustrating example cross-sectional surfaces in different directions corresponding to a rotation direction of a variable member and a moving direction of the variable member in a drum when the drum rotates, in a dryer according to another exemplary embodiment of the present invention.
Figure 12B:
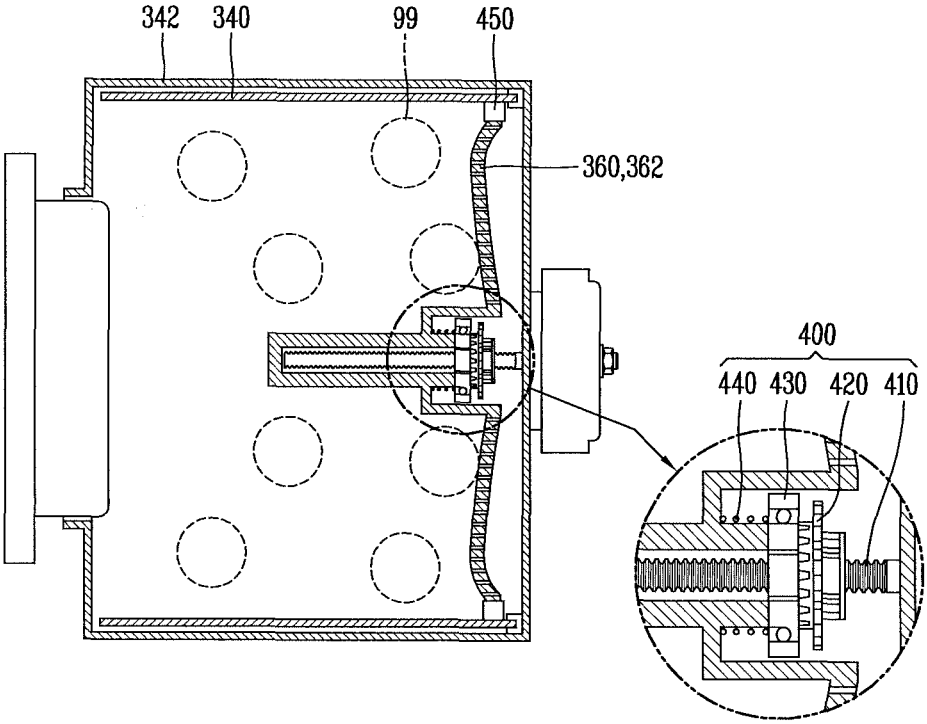

FIGS. 12A and 12B are conceptual diagrams respectively illustrating example cross-sectional surfaces in different directions corresponding to a rotation direction of a variable member 360 and a moving direction of the variable member 360 in a drum 340 when the drum 340 rotates.

The dryer 100 (see FIG. 1) according to one implementation may include the cabinet 110 (see FIG. 1), a tub 342, the drum 340, the variable member 360, and a moving unit 400.

Referring to FIGS. 12A and 12B, the cabinet 100 may form an external appearance of the dryer, and the tub 342 may be disposed in the cabinet 110. Also, the drum 340 may be rotatably disposed in the tub 342, may include a space accommodating target dry items, and may have a cylindrical shape.

The variable member 360 may be disposed in the drum 340 and may have an area corresponding to a rear surface of the drum 340. Also, the variable member 360 may be disposed in the drum 340 to be rectilinearly moved.

The moving unit 400 may be disposed on a rear surface of the tub 342, instead of between the drum 340 and the variable member 360. Also, the moving unit 400 may move the variable member 360 according to the drum 340 being rotated.

The moving unit 400 may include a shaft 410, a first clutch 420, a second clutch 430, a spring 440, and a sealer member 450.

In this case, the shaft 410 may protrude from the rear surface of the tub 342 instead of the rear surface of the drum 340. Therefore, even when the drum 340 rotates, the shaft 410 may not rotate along with the drum 340.

Moreover, the sealer member 450 may apply pressure on the variable member 360 from the drum 340. Since the sealer member 450 applies pressure to the variable member 360, the variable member 360 may rotate along with the drum 340 when the drum 340 rotates.

Therefore, when the drum 340 rotates, the variable member 360 may rotate. When the variable member 360 rotates, the first clutch 420 may rotate. Also, the second clutch 430 engaging with the first clutch 420 may rotate. The second clutch 430 may move to a front surface or a rear surface of the shaft 410 in a lengthwise direction along a screw thread which is formed in the shaft 410.

Figure 13A:
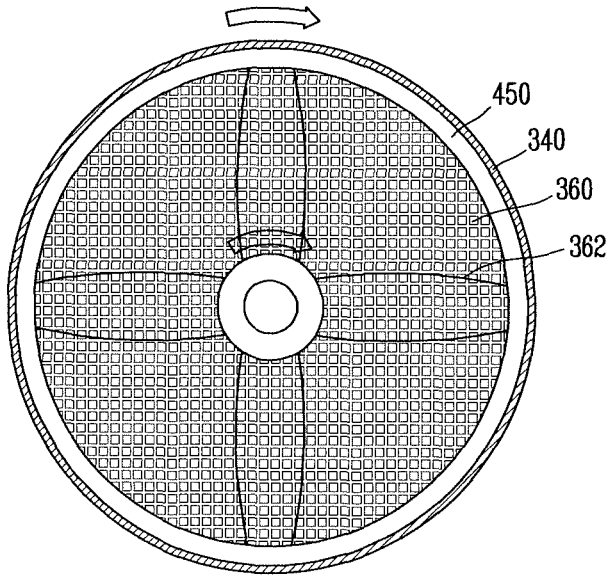
FIGS. 13A and 13B are conceptual diagrams respectively illustrating example cross-sectional surfaces in different directions corresponding to a rotation direction of the variable member and a moving direction of the variable member in the drum when the drum rotates in a direction different from the rotation direction illustrated in FIGS. 12A and 12B.
Figure 13B:
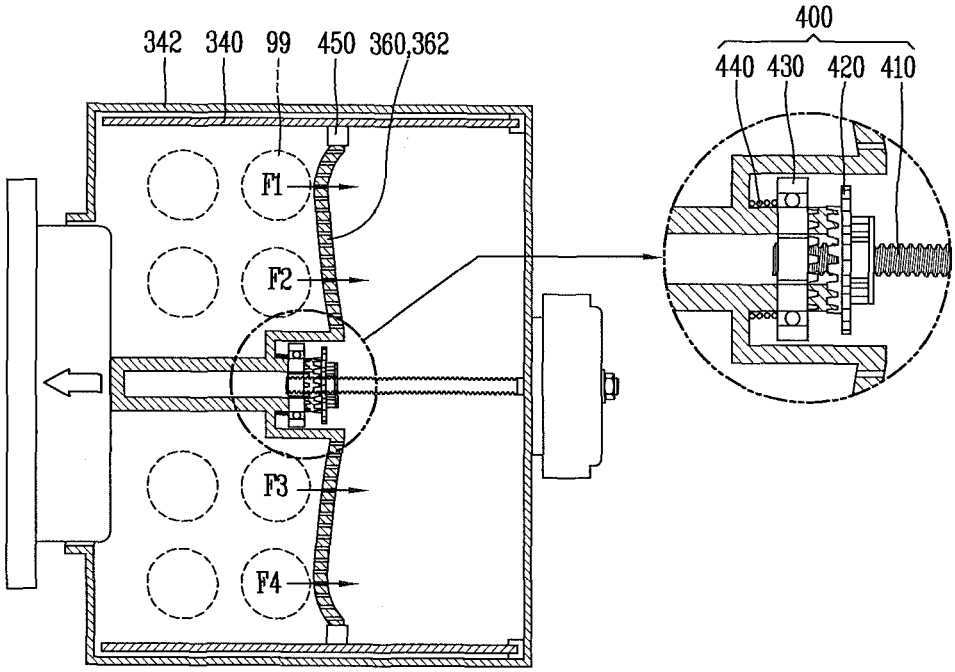

FIGS. 13A and 13B are conceptual diagrams respectively illustrating example cross-sectional surfaces in different directions corresponding to a rotation direction of the variable member 360 and a moving direction of the variable member 360 in the drum 340 when the drum 340 rotates in a direction different from the rotation direction illustrated in FIGS. 12A and 12B.

Referring to FIGS. 13A and 13B, when the variable member 360 moves in a direction toward a front surface of the drum 340 according to rotation illustrated in FIG. 8A, target dry items may apply pressure to the variable member 360.

When a total sum of forces F1, F2, F3 and F4 at which the target dry items apply pressure to the variable member 360 is greater than a force at which the spring 340 applies pressure to the second clutch 430 toward the first clutch 420, the first clutch 220 may be separated from the second clutch 430.

Due to the separation, a force based on a rotation of the first clutch 420 may not be transferred to the second clutch 430. Accordingly, even when the drum 340 rotates, the variable member 360 may no longer move in a direction toward the front surface of the drum 340.

The foregoing descriptions are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described example are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A dryer comprising:

a cabinet that defines an introduction port disposed at a front surface of the cabinet, the introduction port being configured to receive a laundry item;

a drum disposed in the cabinet and configured to receive the laundry item within an internal volume of the drum;

a variable member positioned within the drum and configured to be movable in a lengthwise direction of the drum to thereby vary the internal volume of the drum;

a motor disposed on a rear surface of the drum, the motor including a rotation shaft that is configured to rotate in a forward rotation direction or a reverse rotation direction;

an adjustment shaft coupled to the rotation shaft and configured to extend to a preset position inside the drum; and a bracket fitted to the adjustment shaft and configured to couple the variable member and the adjustment shaft, the coupling of the variable member and the adjustment shaft enabling movement of the variable member according to a rotation of the adjustment shaft, wherein the variable member comprises:

a circular plate having an area that corresponds to an internal cross-sectional surface of the drum, the circular plate being configured to push out the laundry item by moving relative to the drum, and a protrusion that protrudes from a center portion of the circular plate toward the introduction port in an axial direction of the adjustment shaft, the protrusion defining a hollow portion that accommodates a part of the adjustment shaft, wherein the adjustment shaft is configured to, based on the protrusion moving toward the rear surface of the drum, insert into an inside of the hollow portion of the protrusion, and wherein the adjustment shaft is further configured to, based on the protrusion moving toward the introduction port, withdraw from the inside of the hollow portion.

2. The dryer of claim 1, wherein the adjustment shaft further comprises a protrusion pin that extends transversely from one or more sides of the adjustment shaft, and the bracket is coupled to the protrusion pin and configured to move forward or backward along the lengthwise direction of the drum according to a rotation of the protrusion pin.

3. The dryer of claim 2, wherein the bracket further comprises:

a body member defining a hollow portion, the hollow portion being configured to receive the adjustment shaft, a coupling member disposed on one end of the body member, the coupling member extending transversely relative to a lengthwise direction of the body member, and a slot that is defined to extend in a spiral shape, the slot being configured to fittingly receive the protrusion pin; and at least a portion of the coupling member is coupled to the variable member.

4. The dryer of claim 3, wherein the bracket is configured to, based on the protrusion pin rotating with the adjustment shaft, rotate relative to the adjustment shaft in response to a pressure applied on the bracket by the protrusion pin through the slot.

5. The dryer of claim 4, wherein the bracket is configured to, based on the adjustment shaft rotating in a first direction, move the variable member toward a front surface of the drum to thereby reduce the internal volume of the drum, and the bracket is configured to, based on the adjustment shaft rotating in a second direction that is opposite the first direction, move the variable member toward a rear surface of the drum to thereby increase the internal volume of the drum.

6. The dryer of claim 3, wherein the coupling member is coupled to the variable member by at least one of a pin or a bolt.

7. The dryer of claim 3, wherein the protrusion is configured to surround the adjustment shaft along the axial direction of the adjustment shaft.

8. The dryer of claim 7, wherein the body member extends in the lengthwise direction of the drum to thereby allow the variable member to move within a predetermined range from a rear surface of the drum according to a rotation of the adjustment shaft, and the slot extends in a spiral shape along the lengthwise direction of the body member.

9. The dryer of claim 8, wherein the predetermined range within which the variable member moves is a distance between a first position at which the circular plate is disposed adjacent to the rear surface of the drum, and a second position at which the protrusion is disposed adjacent to a door of the drum.

10. The dryer of claim 7, wherein the circular plate comprises a concave-convex portion that is configured to enlarge a contact area between the circular plate and the laundry item, at least a portion of the circular plate being protruded or recessed.

11. The dryer of claim 7, wherein the motor stops rotating or rotates in a reverse direction according to a pressure that is applied by the laundry item on the variable member.

12. The dryer of claim 11, wherein the motor stops rotating based on a force corresponding to the pressure applied to the variable member being equal to a predetermined force, and the motor rotates in the reverse direction based on the force corresponding to the pressure applied to the variable member being greater than the predetermined force until the force corresponding to the pressure applied to the variable member becomes equal to the predetermined force.

13. The dryer of claim 7, wherein the protrusion further comprises a coupling part that extends to a rear surface of the drum along an outer circumference of the protrusion, the coupling part being configured to be coupled to the coupling member.

14. The dryer of claim 3, wherein at least a portion of a rear surface of the drum is recessed to accommodate a portion of the body member.

15. The dryer of claim 1, wherein the circular plate comprises a concave-convex portion that is configured to enlarge a contact area between the circular plate and the laundry item, at least a portion of the circular plate being protruded or recessed.

16. The dryer of claim 1, wherein the motor stops rotating or rotates in a reverse direction according to a pressure that is applied by the laundry item on the variable member.

17. The dryer of claim 16, wherein the motor stops rotating based on a force corresponding to the pressure applied to the variable member being equal to a predetermined force, and the motor rotates in the reverse direction based on the force corresponding to the pressure applied to the variable member being greater than the predetermined force until the force corresponding to the pressure applied to the variable member becomes equal to the predetermined force.

* * * * *